US006885269B2

(12) United States Patent
Miettinen et al.

(10) Patent No.: US 6,885,269 B2
(45) Date of Patent: Apr. 26, 2005

(54) FASTENING DEVICE FOR TOROIDAL CHOKING COIL

(75) Inventors: Osmo Rainer Miettinen, Vaasa (FI); Matti Johannes Pussinen, Laihia (FI)

(73) Assignee: Vacon Oyj, Vaasa (IL)

( * ) Notice: Subject to any disclaimer, the term of this patent is extended or adjusted under 35 U.S.C. 154(b) by 0 days.

(21) Appl. No.: 10/445,881

(22) Filed: May 28, 2003

(65) Prior Publication Data

US 2004/0113733 A1 Jun. 17, 2004

(30) Foreign Application Priority Data

May 31, 2002 (FI) ..... 20021040

(51) Int. Cl.[7] ..... H01F 15/02
(52) U.S. Cl. ..... 336/65; 336/67; 336/229
(58) Field of Search ..... 336/208, 210, 336/229, 65, 67

(56) References Cited

U.S. PATENT DOCUMENTS

| | | | |
|---|---|---|---|
| 4,806,895 A | 2/1989 | Petrow | |
| 2002/0017976 A1 | 2/2002 | Okamoto | 336/229 |

FOREIGN PATENT DOCUMENTS

| | | |
|---|---|---|
| DE | 22 57 605 A | 5/1974 |
| DE | 86 11 261 U | 6/1986 |
| JP | A 2002-118019 | 4/1992 |
| JP | A 7-45444 | 2/1995 |
| JP | A 11-26251 | 1/1999 |
| JP | A 2000-216025 | 8/2000 |
| JP | 2001-110655 | 4/2001 |
| JP | A 2002-57034 | 2/2002 |
| JP | 2002-118018 | 4/2002 |

*Primary Examiner*—Ramon M. Barrera
(74) *Attorney, Agent, or Firm*—Oliff & Berridge, PLC

(57) ABSTRACT

The invention relates to a fastening device for a toroidal choking coil for fastening a toroidal coil (1) to an electric device or a corresponding supporting base (13), the toroidal choking coil comprising an inner circumference defined by a surface parallel with an axis of rotation of the toroidal choking coil (1) and located closest to the axis of rotation, an outer circumference defined by a surface parallel with the axis of rotation of the toroidal choking coil (1) and located outermost from the axis of rotation, and side surfaces defined by surfaces perpendicular to the axis of rotation of the toroidal choking coil (1) and connecting the inner circumference and the outer circumference. The fastening device for a toroidal choking coil of the invention comprises a choking coil base (2) provided with fastening elements (11) for fastening the choking coil base to its base, and at least one choking coil collar (3) for fastening the toroidal choking coil (1) to the choking coil base (2), the choking coil collar (3) being arranged to come into contact with the outer circumference of the toroidal choking coil and the choking coil collar (3) being arranged to be fastened to the choking coil base (2) by suitable fastening elements (4).

11 Claims, 3 Drawing Sheets

FASTENING DEVICE FOR TOROIDAL CHOKING COIL

BACKGROUND OF THE INVENTION

The invention relates to a fastening device for a toroidal choking coil according to the preamble of claim 1 for fastening at least one toroidal choking coil to an electric device or its corresponding base.

A toroidal choking coil is an electrotechnical component wound around a toroidal iron core; more specifically, a coil used for filtering interference in an electric current. A device for fastening a toroidal choking coil refers to a device enabling a toroidal choking coil to be fastened to an electric device or the like.

According to a known solution, a toroidal choking coil is fastened to a base by using a metal collar covered by an insulating sleeve and tightened around the toroidal choking coil by a screw. Since in an implementation according to this solution a large part of the outer circumference of the toroidal choking coil is covered by the insulating sleeve, the toroidal choking coil does not cool down very efficiently. Furthermore, in this solution, in order for the toroidal choking coil to be fastened in a sufficiently strong manner, the screw has to be tightened strongly, which may cause the base to warp.

SUMMARY OF THE INVENTION

An object of the invention is to provide a fastening device for a toroidal choking coil so as to enable above-mentioned problems to be solved.

The object of the invention is achieved by a fastening device for a toroidal choking coil which is characterized by what is disclosed in the independent claim. Preferred embodiments of the invention are disclosed in the dependent claims.

The idea underlying the invention is that a toroidal choking coil is fastened to a separate choking coil base by a choking coil collar. The choking coil base can be fastened to a supporting base, which may consist of an electric device or e.g. a sheet metal frame, which also serves as a guard of the choking coil against external interference and interference caused by the choking coil itself. The choking coil base can be fastened to the supporting base by fastening elements, which extend at least partly to one side of the supporting base, or the choking coil base may also be glued or fastened to its supporting base e.g. by screw-like devices.

Although the choking coil base insulates the choking coil from the frame, the choking coil may be earthed to the frame through the choking coil base e.g. by a screw, if necessary.

The choking coil base and the choking coil collar have in advance been provided with means for supporting the toroidal choking coil both along its outer circumference and its side surfaces. The means of the invention enable a sufficiently strong fastening with reasonable tightening. When the means for supporting the toroidal choking coil are, preferably, made of plastic or another non-conducting material, the choking coils do not have to be insulated separately; neither do they have to be covered unnecessarily. This enables a solution to be achieved which covers the choking coil as little as possible, enabling the choking coil to cool down.

Further advantages of the fastening device for a toroidal choking coil of the invention include low manufacturing and installation costs. When the choking coil base and the choking coil collar are made of a preferred plastic material, it is possible to manufacture such elements in series, which lowers manufacturing costs. Installation time and the related costs are considerably low since the small number of parts and easiness of installation are characteristic of the fastening device of the invention. Installability is also improved by the fact that the choking coil base can be provided with paths for conductors already in advance.

LIST OF DRAWINGS

The invention is now described in closer detail in connection with the preferred embodiments and with reference to the accompanying drawings, in which FIG. 1 shows, as seen obliquely from above, parts of a fastening device for a toroidal choking coil according to an embodiment of the invention;

DETAILED DESCRIPTION OF THE INVENTION

Referring to FIGS. 1 to 6, the structure of a fastening device for a toroidal choking coil according to the invention will be described.

Figure 1:
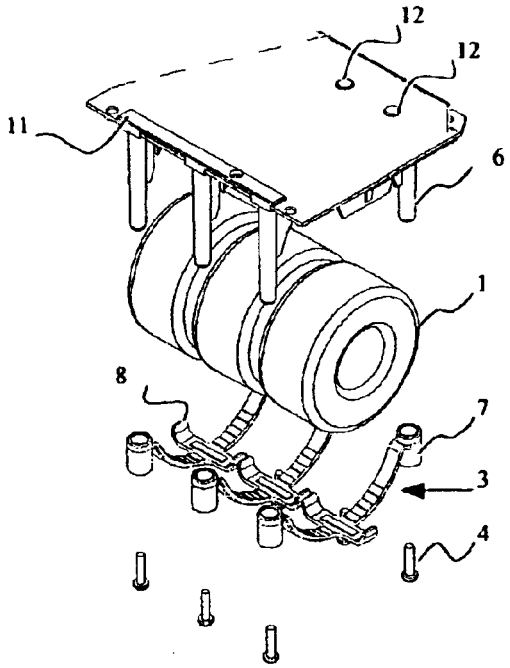
Figure 2:
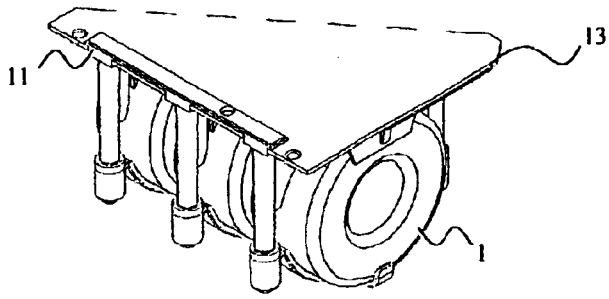
FIG. 2 is a sectional view assembled from the parts of FIG. 1, showing the fastening device for a toroidal choking coil as seen obliquely from above.
Figure 3:
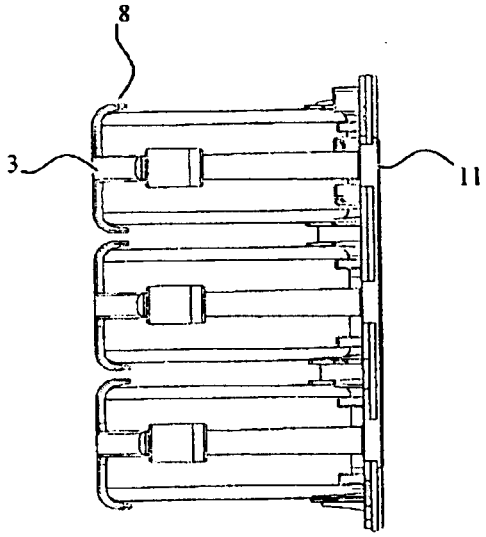
FIG. 3 is a side view showing a fastening device for a toroidal choking coil.
Figure 6:
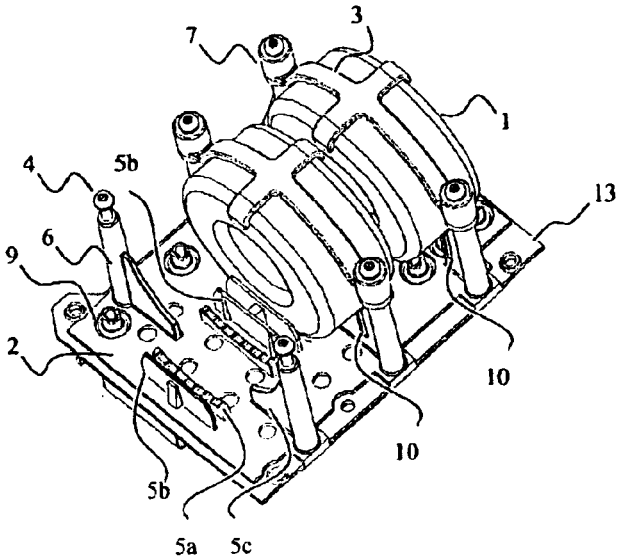
FIG. 6 shows a fastening device for a toroidal choking coil assembled from the parts of FIG. 1, turned upside down and having two choking coils fastened thereto and as seen obliquely from above.

According to FIG. 6, the fastening device for a toroidal choking coil shown in FIGS. 1 to 6 comprises a choking coil base 2, which choking coil base comprises supporting means 5*a* for supporting, over its outer circumference, the toroidal choking coil indicated in FIGS. 1 and 6, side supporting means 5*b* for supporting the toroidal choking coil in a direction of an axis of rotation of the toroidal choking coil, vertical supporting means 5*c* for supporting the toroidal choking coil in a direction perpendicular to the axis of rotation of the toroidal choking coil, and a choking coil collar 3, which is substantially strip-like and which has a sleeve-like element 7 provided in its both ends, arranged to enable the choking coil collar 3 to be fastened to upright projections 6 protruding from the choking coil base 2 by using screws or corresponding fastening elements 4 when the choking coil collar 3 is arranged to be used such that it can be mounted in a direction parallel with the circumference of the toroidal choking coil 1.

Both the choking coil base 2 and the choking coil collar 3 may be uniform pieces cast in plastic, wherefore they are simple and inexpensive to manufacture and wherefore the toroidal choking coil 1 is easy and quick to fasten to the choking coil base 2. When a plastic material is used either in the choking coil base 2 or in the choking coil collar 3, attention should be paid to sufficient heat resistance of the material to be chosen for the purpose.

According to FIG. 6, the plastic choking coil base 2 is preferably provided with integral through holes 9 for the conductors of the toroidal choking coils 1 for conveying the conductors to a connecting point located on another side of the choking coil base 2. In addition, the choking coil base is provided with fastening elements 11 indicated in FIGS. 1, 2, 3 and 5 for fastening the choking coil base to its supporting base 13, indicated e.g. in FIG. 2. The fastening elements 11 may e.g. extend over an edge of the supporting base 13 and partly overlap one side of the supporting base. The supporting base 13 of the choking coil base 2 may be any structure of sufficient rigidity, such as e.g. a galvanized metal sheet. The choking coil base may also be provided with fastening projections 12 indicated in FIGS. 1, 4 and 5, which are received by openings provided in the choking coil base for preventing the choking coil base from becoming disengaged from its supporting base.

It is possible to cast the choking coil base simultaneously with the supporting base by using mould cores such that the materials do not mix up. In such a case, the casting alloy passes through holes provided in the supporting base 13, forming fastening elements 11 and a fastening projection 12 and cooling down on one side of the support base, providing a secure fastening between the supporting base and the choking coil base. When the choking coil base 2 is made of an electrically non-conductive material, it may also be fastened to the supporting base 13 through the choking coil base by screw-like devices.

In some cases, e.g. when fastening small toroidal choking coils 1, it may be advantageous to use the solution of the invention, wherein the choking coil base 2 and the choking coil collar 3 consist of the same casting, so that only one fastening element 4, such as a screw, is necessary for fastening each toroidal choking coil 1 to the choking coil base 2. In accordance with the invention, it is also possible to provide a free end of a choking coil collar 3 of the type described above with an integral snap connector which may be of the type used e.g. in cable ties or electric connectors, in which case no separate fastening element 4 is needed for fastening the toroidal choking coil 1 to the choking coil base 2, wherefore installation becomes ever quicker.

An advantage of the fastening device for a toroidal choking coil of the invention is that if desired, the same choking coil collar type may be used for supporting toroidal choking coils of different sizes since the curvature of the choking coil collar 3 made of a flexible material can be readily bent to correspond with the diameters of toroidal choking coils 1 of different sizes. The possibility to use the same choking coil collar type for fastening toroidal choking collars of different sizes lowers the costs.

A choking coil base 2 may be shared by several toroidal choking coils 1. FIGS. 1 to 6 show an embodiment wherein a base is shared by three toroidal choking coils; however, a choking coil base 2 may easily be manufactured for a desired number of toroidal choking coils 1. When the toroidal choking coil is e.g. as shown in FIGS. 1 to 6, a shared plate-like choking coil base 2 provides the fastening of all three toroidal choking coils with additional strength conjointly. The structure of the choking coil base 2 of the invention may also consist of modules, in which case at least one supporting means 5*a* indicated in FIG. 6 or vertical supporting means 5*c* indicated in FIGS. 4 and 6 for supporting the toroidal choking coil 1 over at least one segment of the outer circumference and/or at least one side supporting means 5*b* indicated in FIGS. 4 and 6 for supporting the toroidal choking coil 1 in a direction of an axis of rotation of the toroidal choking coil is a part separate from the choking coil base 2, fastened to the choking coil base by appropriate fastening elements. An advantage of such a module-structured choking coil base is that it can be readily arranged for supporting toroidal choking coils of different sizes. A module-structured choking coil base may be e.g. of the type to be assembled by means of screws or suitable claw connectors.

The inner surface of the choking coil collar 3 of the invention, i.e. in a usage situation its surface facing the toroidal choking coil 1, may be provided with different elevations, recesses or other elements or shapes arranged to strengthen the fastening of the toroidal choking coil 1. The outer circumference of the choking coil collar of the invention may further be provided with suitable shapes and elevations, such as cooling rib type elevations for improving the cooling of the toroidal choking coil 1. Furthermore, the choking coil collar 3 of the invention may comprise holes arranged therethrough to lighten the structure and improve the cooling of the toroidal choking coil 1.

The supporting means 5*a* and the vertical supporting means 5*c* for supporting the toroidal choking coil 1 along its outer circumference may support the toroidal choking coil at a circumferential segment of the particular outer circumference over the entire width of the toroidal choking coil, or only over a part thereof. The vertical supporting means 5*c* shown in FIG. 6, for instance, support the toroidal choking coil 1 only in a line-like manner, thus covering as little as possible of the outer circumference of the toroidal choking coil as viewed in the direction of width. Despite their line-like nature, the vertical supporting means 5*c* are strong since they have a connection with the upright projections 6 protruding from the choking coil base 2, to which the choking coil collar 3 is fastened using suitable fastening elements, such as screws.

Furthermore, the supporting means 5*a* and the vertical supporting means 5*c* are substantially protruding from the choking coil base 2, supporting the toroidal choking coil along its outer circumference, simultaneously providing an air gap between the outer circumference of the toroidal choking coil and the choking coil base. The supporting means 5*a* for supporting the toroidal choking coil 1 over at least one segment of the outer circumference and the side supporting means 5*b* for supporting the toroidal choking coil 1 in a direction of an axis of rotation of the toroidal choking coil may, if desired, comprise air intakes, cooling ribs or the like.

In order to support the toroidal choking coil 1, the supporting means 5*a* or the vertical supporting means 5*c* may, at least over one segment of the outer circumference as shown in FIG. 6, be provided with one or more grooves 10 for receiving the conductors of the toroidal choking coils conveyed from the toroidal choking coils to a desired connecting point. The grooves 10 are preferably perpendicular to the choking coil base 2, so that the open ends of the grooves reside in the end further away from the choking coil base. When the conductors conveyed from the toroidal choking coil 1 are received by the above-mentioned grooves 10, the path of the conductors from the toroidal choking coil to a desired connecting point can be determined more accurately, enabling the paths of the conductors to be conveyed so as to avoid places where rubbing of the conductors might cause a short circuit. When the supporting means 5*a* for supporting the toroidal choking coil 1 are made of a plastic material over at least one segment of the outer circumference, no need exists to insulate the conductors arranged in the above-mentioned grooves 10 separately at the grooves.

Preferably, the choking coil collar 3 is arranged to be used such that it is installed substantially in a direction parallel with the circumference of the toroidal choking coil; however, other directions are also possible for installation, such as installation in a direction parallel with an axis of the toroidal choking coil. The width of the choking coil collar may vary according to the purpose of use, such as fastening strength requirements, necessary cooling, etc.

Figure 4:
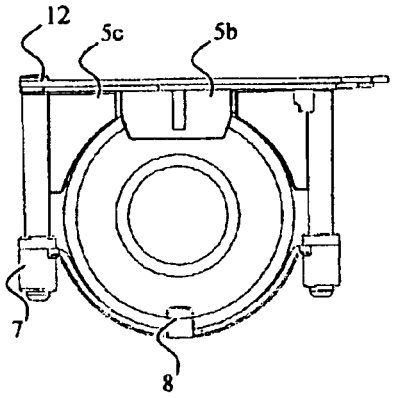
FIG. 4 shows a fastening device for a toroidal choking coil as seen from one end.
Figure 5:
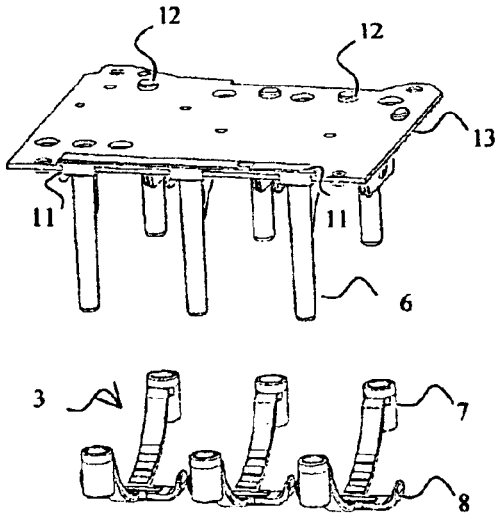
FIG. 5 shows a choking coil base of a toroidal choking coil fastened to its supporting base, as seen obliquely from above.

Preferably, the choking coil collar 3 comprises at least one transverse support 8 indicated in FIGS. 1 and 4, provided for supporting the toroidal choking coil in a direction of its axis of rotation. The transverse support 8 arranged in the choking coil collar 3 supports the toroidal choking coil 1 particularly over a section located outermost from the choking coil base 2. The choking coil collar 3 then supports the toroidal choking coil 1 in a direction of an axis of rotation and in a direction perpendicular to the direction of the axis of rotation. In such a case, a smaller compression against the toroidal choking coil 1 will suffice for the choking coil collar 3 in order to achieve a sufficient support. When the choking coil collar is as shown in FIG. 1, it covers the outer circumference of the toroidal choking coil 1 only partly, enabling the toroidal choking coil to cool down effortlessly over the section of the toroidal choking coil which has not been covered. If desired, the number of transverse supports 8 may also be larger, and some of them may be integral parts of the choking coil collar while some may be of the type to be arranged during the installation stage.

When a choking coil collar 3 equipped with at least one transverse support is used for fastening the toroidal choking coil 1 to the choking coil base 2, preferably at least one transverse support 8 comes into contact with the toroidal choking coil 1 at a point which is substantially on a side of the toroidal choking coil opposite to the choking coil base 2.

It is to be noted that although parts of the toroidal choking coil have herein been referred to as "circumference" and "axis of rotation", the toroidal choking coil 1 of the invention does not have to be toroidal, although toroidal choking coils typically used are substantially toroidal.

It is obvious to one skilled in the art that the basic idea of the invention can be implemented in many different ways. The invention and its embodiments are thus not restricted to the examples described above but they may vary within the scope of the claims.

What is claimed is:

1. A fastening device for a toroidal choking coil for fastening a toroidal coil to an electric device or a corresponding supporting base, the toroidal choking coil comprising:

an inner circumference defined by a surface parallel with an axis of rotation of the toroidal choking coil and located closest to the axis of rotation;

an outer circumference defined by a surface parallel with the axis of rotation of the toroidal choking coil and located outermost from the axis of rotation, and;

side surfaces defined by surfaces perpendicular to the axis of rotation of the toroidal choking coil and connecting the inner circumference and the outer circumference, a choking coil base arranged to fasten to the supporting base, a supporting means projecting from the choking coil base such that the outer circumference of the toroidal choking coil does not come into contact with a surface of the choking coil base when the outer circumference of the toroidal choking coil comes into contact with the supporting means, and wherein the choking coil base comprises at least one vertical supporting means arranged to come into contact with the outer circumference of the toroidal choking coil for supporting the toroidal choking coil in a direction perpendicular to the axis of rotation, at least one choking coil collar for fastening the toroidal choking coil to the choking coil base, the choking coil collar being arranged to come into contact with the outer circumference of the toroidal choking coil and to be mechanically connectible to the choking coil base such that upon connecting the choking coil collar, it generates forces perpendicular to the axis of rotation of the toroidal choking coil for supporting the toroidal choking coil.

2. The fastening device for a toroidal choking coil of claim 1, wherein the vertical supporting means is provided with one or more grooves for receiving conductors of toroidal choking coils conveyed to a desired connecting point.

3. The fastening device for a toroidal choking coil of claim 1, wherein the choking coil base comprises side supporting means arranged to at least partly come into contact with a side surface of the toroidal choking coil for supporting the toroidal choking coil in the direction of the axis of rotation.

4. The fastening device for a toroidal choking coil of claim 1, wherein the vertical supporting means for supporting the toroidal choking coil in the direction perpendicular to the axis of rotation or the side supporting means for supporting the toroidal choking coil in the direction of the axis of rotation of the toroidal choking coil, or both, are an integral part of the choking coil base.

5. The fastening device for a toroidal choking coil of claim 1, wherein the choking coil base is arranged to fasten to the supporting base by a fastening element and/or a fastening projection.

6. The fastening device for a toroidal choking coil of claim 1, wherein the choking coil collar is substantially strip-like and at least one of its ends is provided with a sleeve-like element or the like arranged to enable the choking coil collar to be fastened to upright projections protruding from the choking coil base by using suitable fastening elements, the choking coil collar being arranged to be used such that it is mounted substantially on the outer circumference of the toroidal choking coil.

7. The fastening device for a toroidal choking coil of claim 1, wherein the choking coil collar comprises at least one transverse support for supporting the toroidal choking coil in the direction of its axis of rotation, the transverse support comprising at least one element formed to come into contact with a side surface of the toroidal choking coil, or a part thereof.

8. The fastening device for a toroidal choking coil of claim 7, wherein at least one of the transverse supports of the choking coil collar can be placed such that when using the choking coil collar for fastening the toroidal choking coil to the choking coil base, the transverse support comes into contact with the toroidal choking coil at a point which resides substantially on a side of the toroidal choking coil opposite to the choking coil base.

9. The fastening device for a toroidal choking coil of claim 7, wherein at least one transverse support is an integral part of the choking coil collar.

10. The fastening device for a toroidal choking coil of claim 1, wherein the choking coil base is provided with integral through holes for the conductors of the toroidal choking coils for conveying the conductors to another side of the choking coil base.

11. The fastening device for a toroidal choking coil of claim 1, wherein the choking coil base and the choking coil collar are made of a plastic material.

* * * * *